US005205235A

United States Patent [19]

Hodges

[11] Patent Number: 5,205,235

[45] Date of Patent: Apr. 27, 1993

[54] EXTERNAL RAIL SYSTEM FOR BOATS

[76] Inventor: Christopher A. Hodges, 706 Greatplain Ave., Needham, Mass. 01292

[21] Appl. No.: 855,354

[22] Filed: Mar. 13, 1992

[51] Int. Cl.[5] ..... B63B 1/32

[52] U.S. Cl. ..... 114/290; 114/97; 114/219

[58] Field of Search ..... 114/218, 219, 283, 288, 114/290, 97, 98; 293/128

[56] References Cited

U.S. PATENT DOCUMENTS 3,361,104 1/1968 Glass ..... 114/290
4,548,150 10/1985 Drewett ..... 114/219

FOREIGN PATENT DOCUMENTS 762452 4/1934 France ..... 114/290

*Primary Examiner*—Jesus D. Sotelo

[57] ABSTRACT

A system of elongated rails installed on the exterior hull surfaces of boats and projecting externally from the exterior hull surfaces of the boats, and having the functional attributes of: deflecting spray, reducing the tendencies of the bows to go under in choppy or turbulent seas, reducing heel and side-slipping while turning, contributing lift, acting as fenders to protect the hulls, providing accessible hand holds and foot steps, reducing the rocking motions of the boats and adding floatation to the boats.

19 Claims, 8 Drawing Sheets

EXTERNAL RAIL SYSTEM FOR BOATS

BACKGROUND OF THE INVENTION

1. Technical Field

This invention relates to an external rail system for boats in which elongated rails are structurally affixed to the external surfaces of boat hulls.

2. Background

The problems in the art to which this invention apertains are the need for an external rail system for boats in which elongated rails are structurally affixed to the external surfaces of boat hulls and by which such rails collectively have, some and in some cases all, of the following functional attributes of deflecting spray; of reducing the tendency of the bow to go under in choppy or turbulent seas; of reducing heel and side-slipping while turning; of contributing lift to a fast-moving hull; of acting as a fender to protect the hull; of contributing a safety factor by providing an accessible hand hold or foot step for swimmers or a man overboard; of reducing the rocking motion of the boat while moored or anchored; and of adding floatation to the boat.

SUMMARY OF THE INVENTION

Accordingly, the objects of the invention are to contribute to the solutions of the discussed problems of the art by providing an external rail system for boats in which elongated rails are discretely installed by structural bonding to the external surfaces of boat hulls and whereby, collectively, the rails, as discretely positioned, emplaced and affixed, will have some if not all, of the following functional attributes, to wit: to deflect spray away from the boats; to reduce the tendency of the bows of the boats to go under while moving through choppy or turbulent seas; to reduce heel and side-slipping of the boats while turning; to contribute a degree of lift to the hulls of fast-moving boats; to act as fenders to protect the hulls of boats; to contribute a safety factor by providing accessible hand holds or foot steps for a man or woman overboard, or swimmer, whether or not in distress, by which access to the boats can be gained; to reduce the rocking motions of boats while moored or anchored, brought about by the wakes from another moving boat; and to add additional floatation to the boats.

BRIEF DESCRIPTION OF THE DRAWINGS

These objects and other objects of the invention should be discerned and appreciated from the detailed descriptions of the preferred embodiments of the invention, taken in conjunction with the drawing figures, wherein like reference numerals refer to similar parts throughout the several views, in which.

DETAILED DESCRIPTIONS OF THE PREFERRED EMBODIMENTS

Figure 1:
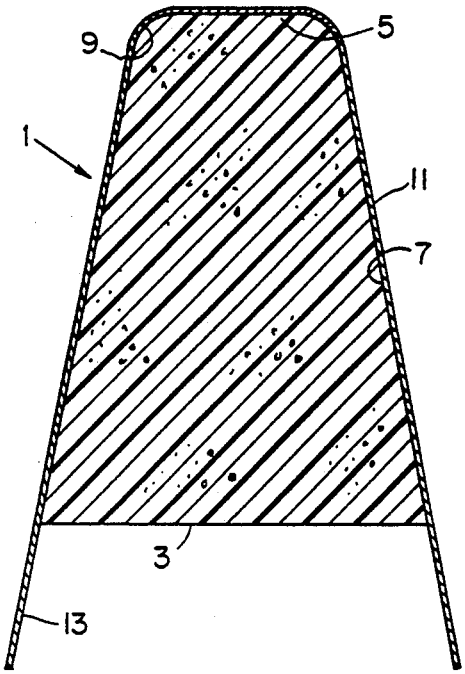
FIG. 1 is a cross-sectional blown-up view of the elongated rail.

In FIG. 1 of the drawings, reference numeral 1 generally refers to the invention of the elongated rail, shown in cross section. In cross section, rail 1 defines a truncated isosceles triangle having a bottom base 3, a top base 5 and lateral sides 7. The top base 5, joining the uppermost portions of the lateral sides 7, has radius-curve corners 9. The interior of the rail 1 is polyethylene foam, coated with an exterior skin 11 of woven fabric material with end flaps 13. The polyethylene foam is of the type manufactured and sold by DOW CHEMICAL COMPANY under its trademark "ETHAFOAM" brand polyethylene closed cell foam per its form number 172-1246-88 and whose products vary from #200LC having an average density of 1.9 PCF (pounds per cubic foot); #220 having an average density of 2.2 PCF; #HS45 having an average density of 3.8 PCF; #HS600 having an average density of 6.6 PCF; to #HS900 having an average density of 9.5 PCF. The greater the PCF density of such foam, the greater will be the strength and structural rigidity imparted to the rail. As will be hereinafter described, the elongated rails discretely positioned, emplaced and structurally affixed at various locations on the hull vary as to the discrete strength and structural rigidity required consistent with the functional attributes to be afforded. The general dimensions of the rail are a 2" bottom-base width, a 2¾" vertical height and a 1" top-base width. Such dimensions will vary, depending on whether the boat is very small or very large.

Figure 2:
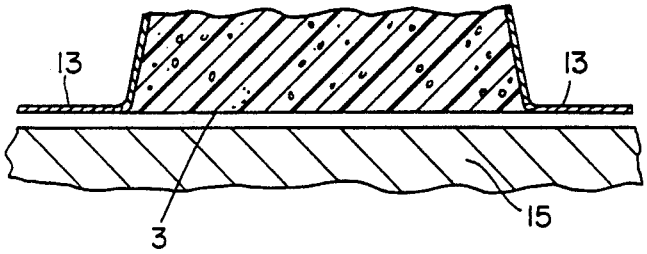
FIG. 2 is a view of a portion of the rail, preparatory to its being discretely positioned emplaced and structurally affixed to a hull portion of a boat.

FIG. 2 shows a rail, preparatory to its being discretely positioned, emplaced and structurally affixed to a hull portion 15 of a boat. To render an elongated rail for discrete positioning and emplacement on a hull surface, commercial contact adhesive is first appropriately applied to both the exposed exterior surface of the bottom base 3 and its proposed mating hull surface, and then followed by the rail being pressed to effect engagement of the adhesive coated surfaces of the bottom base 3 and mating hull. Structural bonding of the rail, so discretely positioned and emplaced on the exterior hull surface, is effected by appropriate application of a two-part epoxy or water-proof methacrylate adhesive to the corresponding exposed surfaces of the end flaps 13 and the hull, followed by appropriate pressure application to effect thereby a strong structural bond of the rail to the hull.

Hereinafter, throughout the specification, "installed" will mean the discrete positioning and emplacement of an elongated rail on a hull surface, together with the structural bonding of such rail where it was discretely positioned and emplaced on the hull surface.

Figure 4:
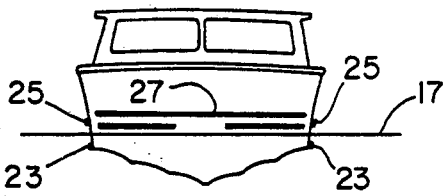
FIGS. 3–6 are front-elevational, starboard-side elevational and perspective views, respectively, of a boat having a displacement planing type or deep-v hull.
Figure 5:
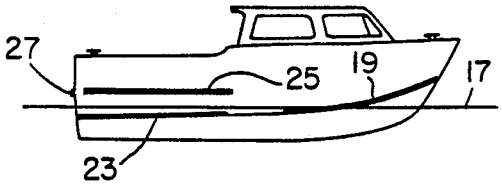
Figure 6:
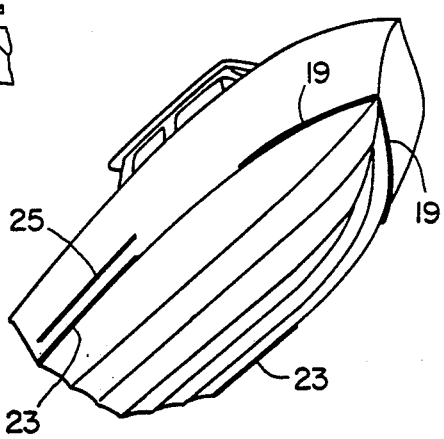
Figure 3:
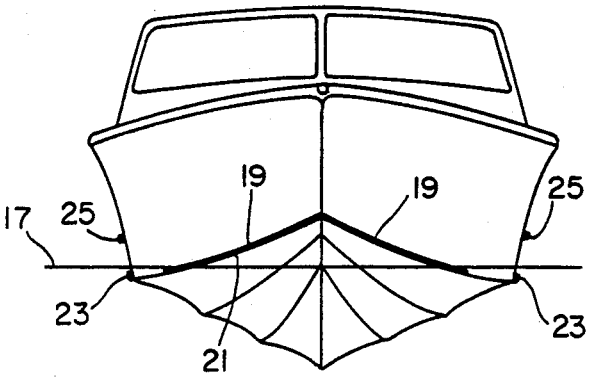

Depending upon the types of boats to be described, the specific hull locations at which the rails are installed, and the discrete ranges of PCF densities of the polyethylene foam for the various rails that are utilized, such rails will have the functional attributes denoted by the following letter codes:

A to deflect spray away from the boat
B to reduce the tendency of the bow to go under while the boat is moving through choppy or turbulent seas
C to reduce heel and side-slipping of the boat while turning
D to contribute a degree of lift to the hull(s) of a fastmoving boat
E to act as a hull-protecting fender
F to provide accessible hand holds or foot steps for a man or woman overboard, or a swimmer, whether or not in distress, by which access to the boat can be gained
G to reduce the rocking motion of a boat
H to add additional floatation to the boat In FIGS. 3–6, which depict a boat having a displacement planing type or deep-v hull. FIG. 3 is a front-elevational view, FIG. 4 is a rear-elevational view, FIG. 5 is a starboard-side elevational view and FIG. 6 is a perspective view. A port-side elevational view would be the same as FIG. 5. The waterline is indicated by reference numeral 17. The bow rails 19 are installed, as shown, starting at the bow and running aft toward the midship sections, with the bow rails being positioned on the upper sides of the chine edges 21. The densities of the bow rails range from 2.2 to 6.6 PCF and the bow rails 19 have the functional attributes A, B, D, E, F, and H. Rails 23 are similarly installed, on both the starboard and port sides, along the chine edges, starting from the stern and running toward the midship sections. The densities of the rails 23 range from 2.2 to 6.6 PCF and the rails 23 have the functional attributes A, C, D, E, F, G and H. The fender rails 25 are similarly installed horizontally on both the starboard and port sides, 8" to 24" above the waterline 17, and their dimensional lengths approximate the dimensional lengths of the rails 23. The densities of the rails 25 range from 2.2 to 9,5 PCF and the rails 25 have the functional attributes E, F and H. The stern rail 27 is horizontally installed across the full width of the transom, 6" to 10' above the waterline 17. The stern rail 27 may have to be cut to provide clearance for swim-platform brackets, boarding ladders, etc. The stern rail 27 has a density ranging from 2.2 to 6.6 PCF and its functional attributes are A, E, F and H.

Figure 7:
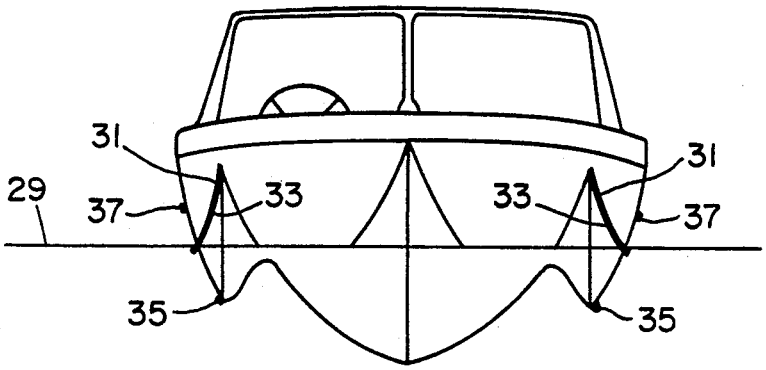
FIGS. 7–10 are front-elevational, port-side elevational and perspective views, respectively, of a boat having a cathedral planing type hull.
Figure 8:
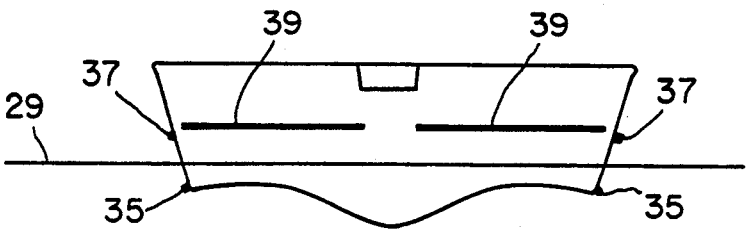
Figure 9:
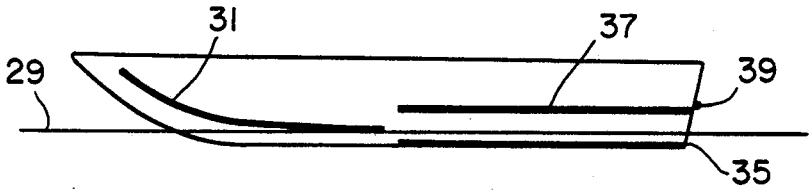
Figure 10:
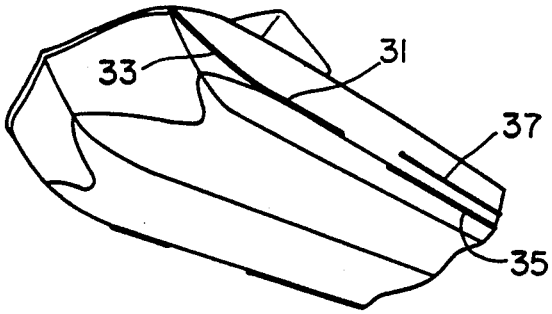

In FIGS. 7–10, which depict a boat having a cathedral planing type hull, FIG. 7 is a front-elevational view, FIG. 8 is a rear-elevational view of the hull, FIG. 9 is a port-side elevational view of the hull and FIG. 10 is a perspective view. A starboard-side view should be the same as FIG. 9. The waterline 29 is indicated by reference numeral 29. The bow rails 31 are installed, starting at the bow and running aft toward the midship sections, with the bow rails 31 being positioned on the upper sides of the chine edges 33. The bow rails 31 have densities ranging from 2.2 to 6.6 PCF and functional attributes A, B, D, E, F and H. Rails 35 are similarly installed, on both the port and starboard sides, along the chine edges, starting from the stern and running to the midship sections. The rails 35 have densities ranging from 2.2 to 6.6 PCF and functional attributes A, C, D, E, F, G and H. The fender rails 37 are similarly installed, on both the port and starboard sides, 8" to 24" above the waterline 29, and their dimensional lengths approximate the dimensional lengths of the rails 35. The rails 37 have densities ranging from 2.2 to 9.5 PCF and have functional attributes E, F and H. The stern rails 39, in two sections to provide space in the middle of the transom for an outdrive unit or outboard, are horizontally installed, otherwise, across the width of the transom, 6" to 10" above the waterline 29. The stern rails 39 range in their densities from 2.2 to 6.6 PCF and have functional attributes A, E, F and H.

Figure 11:
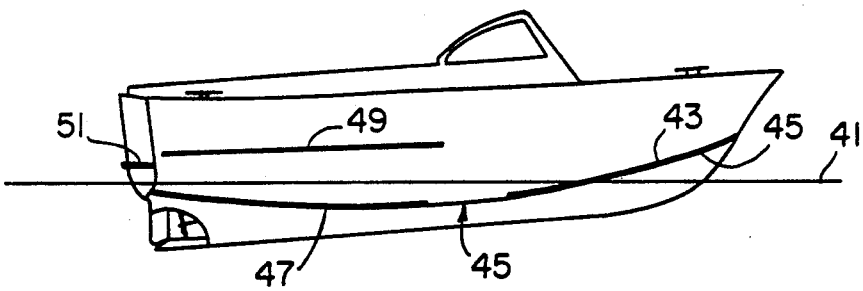
FIGS. 11–14 are starboard-side elevational, front-elevational, full-rear (and partial starboard side and partial bottom) perspective, and full port-side and full-bottom (and partial starboard-side) perpective views, respectively of a typical flatbottomed runabout boat.
Figure 12:
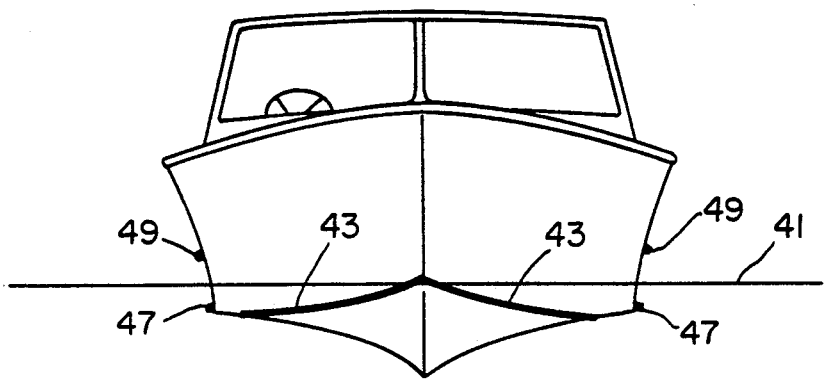
Figure 13:
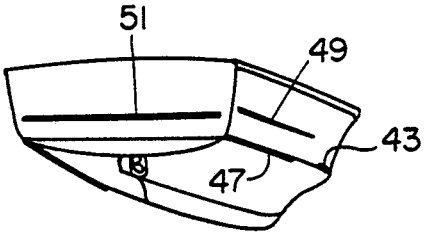
Figure 14:
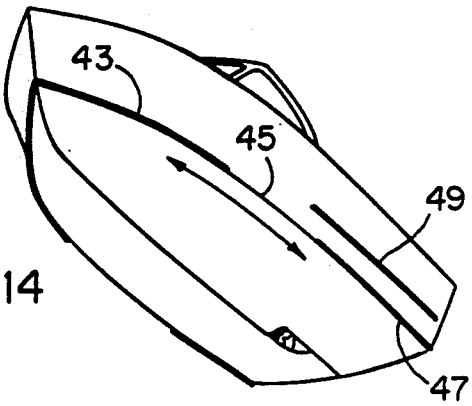

In FIGS. 11–14, which depict a typical flatbottomed runabout boat, FIG. 11 is a starboard-side elevational view, FIG. 12 is a front-elevational view, FIG. 13 is a perspective view from the rear and showing only the hull, and FIG. 14 is a perspective view. The waterline is indicated by reference numeral 41. The bow rails 43 are installed, starting at the bow and running aft toward the midship sections, with the bow rails 43 being positioned on the upper sides of the chine edges 45. The bow rails 43 have densities ranging from 2.2 to 6.6 PCF and functional attributes A, B, D, E, F and H. Rails 47 are similarly installed, on both the starboard and port sides, along the chine edges, starting from the stern and running to the midship sections. The rails have densities ranging from 2.2 to 6.6 PCF and functional attributes A, C, D, E, F, G and H. The fender rails 49 are similarly installed on both the starboard and port sides, 8" to 24" above the waterline 41, and their dimensional lengths approximate the dimensional lengths of the rails 47. The fender rails have densities ranging from 2.2 to 9.5 PCF and functional attributes E, F and H. The stern rail 51 is horizontally installed across the full width of the transom, 6" to 10" above the waterline 41. The stern rail 51 may have to have a section removed to spatially provide clearance for swim-platform brackets, boarding ladders, etc. The stern rail 51 has its density ranging from 2.2 to 6.6 PCF and functional attributes A, E, F and H.

Figure 15:
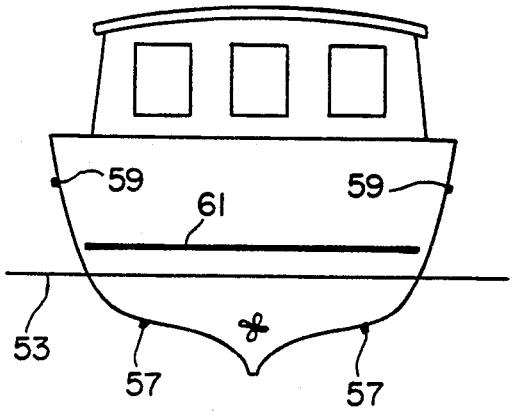
FIGS. 15–18 are rear-elevational, front-elevational, starboard-side elevational and perspective views, respectively, of a round-bottomed cruiser-type boat.
Figure 16:
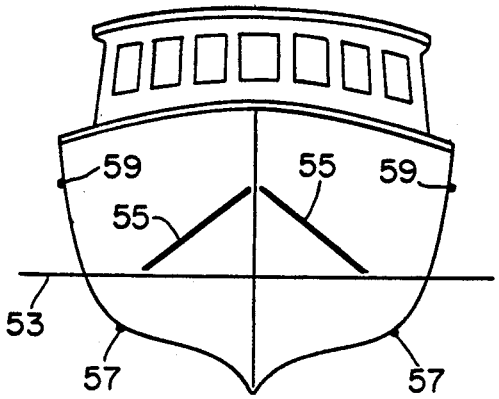
Figure 17:
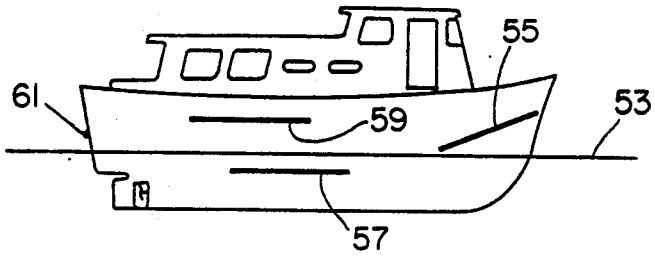
Figure 18:
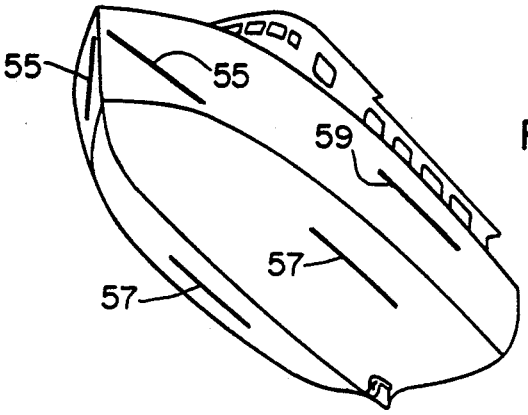

In FIGS. 15–18, which depict a round-bottomed cruiser-type boat, FIG. 15 is a rear-elevational view, FIG. 16 is a front-elevational view, FIG. 17 is a starboad-side elevational view and FIG. 18 is a perspective view. The waterline is indicated by reference numeral 53. For round-bottomed cruiser-type boats and sailboats whose hull lengths range from 28' to 40', the bow rails 55 are installed approximately 24" to 36" above the waterline 53, 2" back from the stem, running toward the waterline 53 at an acute angle of 10° to 30°. Assuming for purposes of trignometric construction, with reference to FIG. 17, that the waterline 53 defines a coincident imaginary rectilinear base line and assuming that a second imaginary rectilinear line, coincident with the bow rail 55, is extended to intersect such base line; accordingly, such second lines defines trignometrically with such base line, from the aspect of counterclockwise rotation, such (positive) acute angle of 10° to 30°. With hull lengths of less than 28', the bow rails 55 would be installed approximately 12" to 24" above the waterline 53, 2" back from the stem, running toward the waterline 53 at such acute angle of 10° to 30°. The bow rails 55 have densities ranging from 2.2 to 6.6 PCF and functional attributes A, B, D, E, F and H. Rails 57 are installed below the waterline 53, as shown, substantially amidships and approximately one-third of the distance from the waterline 53 to the keel. Rails 57 have densities ranging from 2.2 to 6.6 PCF and functinal attributes G and H. The fender rails 59 are horizontally installed on both the starboard and port sides, 8" to 24" above the waterline 53, running from the midship section to the stern, but spatially occupy approximately two-thirds of the distance from the midship sections to the stern. The rails 59 have densities ranging from 2.2 to 9.5 PCF and functional attributes E, F and H. The stern rail 61 is horizontally installed across the full width of the transom, 6" to 10" above the waterline 53. The stern rail 61 may have to have a section removed to spatially provide clearance for swim-platform brackets, boarding ladders, etc. The stern rail has its density ranging from 2.2 to 6.6 PCF and functional attributes A, E, F and H.

Figure 19:
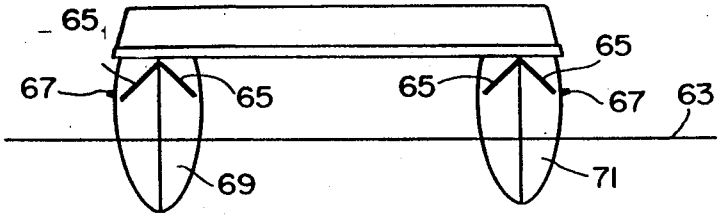
FIGS. 19–21 are front-elevational, starboard-side elevational and rear-elevational views, respectively, of a double-hulled (catamaran) power boat.
Figure 20:
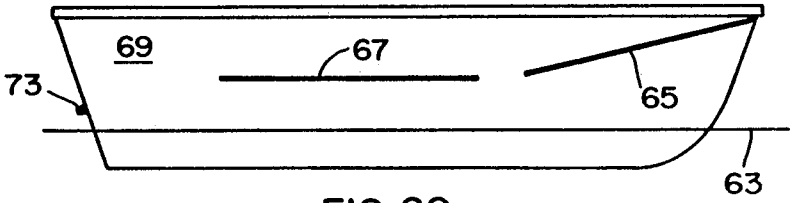
Figure 21:
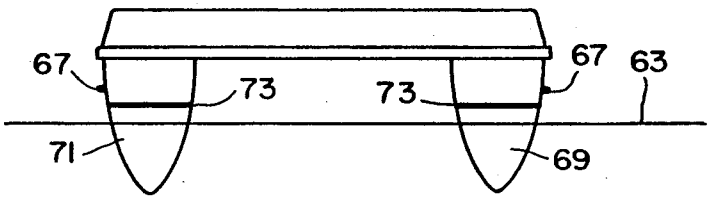

In FIGS. 19–21, which depict a double-hulled (catamaran) power boat, FIG. 19 is a front-elevational view, FIG. 20 is a starboard-side elevational view and FIG. 21 is a rear-elevational view. A port-side elevational view would be the same as FIG. 20. The waterline is indicated by reference numeral 63. The bow rails 65 are installed from the stem and run toward the waterline 63 at an acute angle ranging from 5° to 20°. The bow rails 65 have densities ranging from 2.2 to 6.6 PCF and functional attributes A, B, D, E, F and H. The fender rails 67 are horizontally installed substantially amidships at a distance of 8" to 24" above the waterline 63. Only two fender rails 67 are installed: one fender rail 67 being installed on the starboard side of the starboard hull 69 and the second fender rail 67 being installed on the port side of the port hull 71. The fender rails 67 have densities ranging from 2.2 to 9.5 PCF and functional attributes E, F and H. One stern rail is horizontally installed across the full width of the transom of the starboard hull 69, 6" to 10" above the waterline 63; and the second stern rail 73 is horizontally installed across the full width of the transom of the port hull 71, 6" to 10" above the waterline 63. Either or both stern rails 73 may have to have a section removed to spatially provide clearance when necessary. THe stern rails 73 have densities ranging from 2.2 to 6.6 PCF and have functional attributes A, E, F and H.

Figure 22:
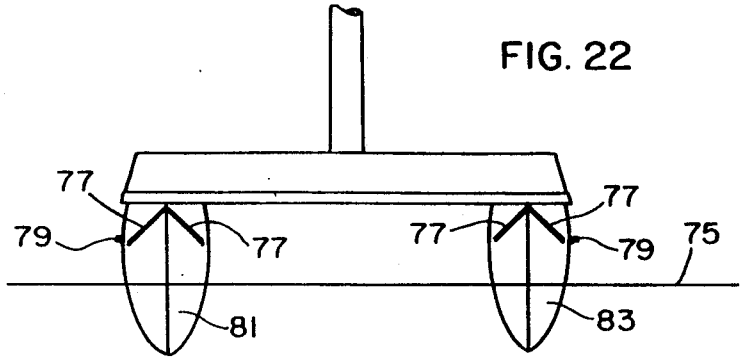
FIGS. 22–24 are front-elevational, starboard-side elevational and rear-elevational views, respectively, of a double-hulled (catamaran) sailboat.
Figure 23:
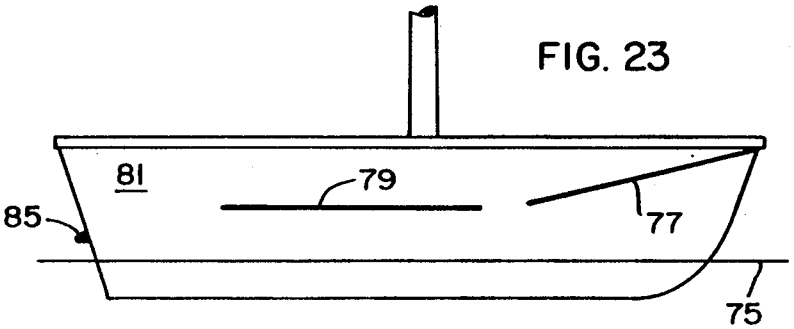
Figure 24:
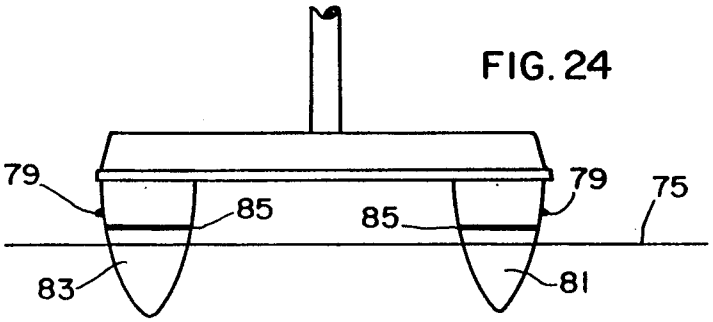

In FIGS. 22–24, which depict a double-hulled (catamaran) sailboat, FIG. 22 is a front-elevational view, FIG. 23 is a starboard-side elevational view and FIG. 24 is a rear-elevational view. A port-side elevational view would be the same as FIG. 23. The waterline is indicated by reference numeral 75. Reference numerals 81 and 83 are applied to the starboard hull and port hull, respectively. The bow rails 77, fender rails 79 and stern rails 85 are installed the same as respective bow rails 65, fender rails 67 and stern rails 73 have been described with reference to FIGS. 19–21, and have the same respective densities and functional attributes.

Figure 25:
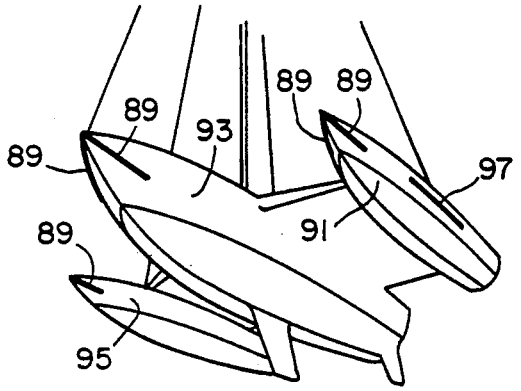
FIGS. 25–28 are perspective, front-elevational, port-side elevational and rear-elevational views, respectively, of a multihulled (trimaran) sailboat.
Figure 26:
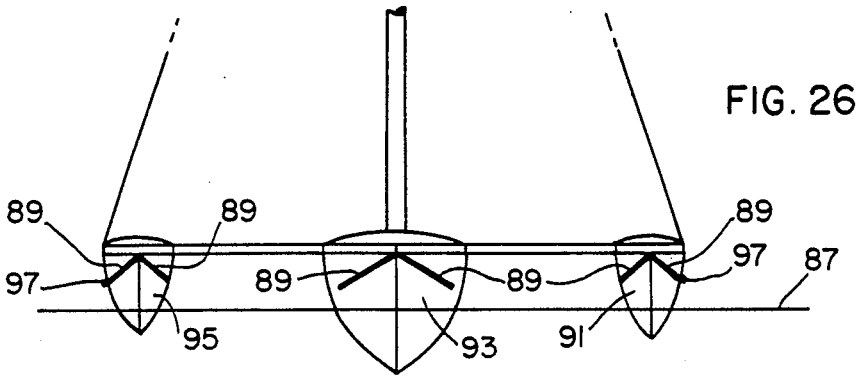
Figure 27:
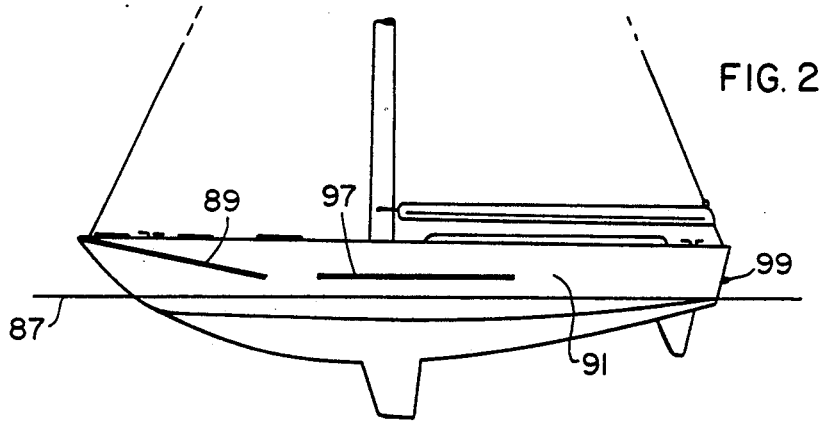
Figure 28:
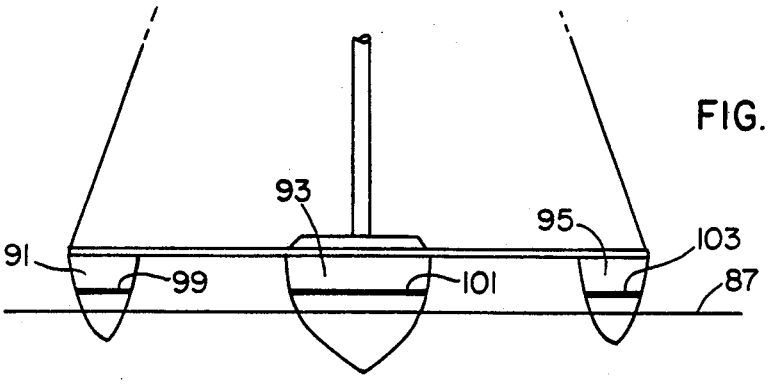

In FIGS. 25–28, which depict a multihulled (trimaran) sailboat, FIG. 25 is a perspective view, FIG. 26 is a front-elevational view, FIG. 27 is a port-side elevational view and FIG. 28 is a rear-elevational view. A starboard-side elevational view would be the same as FIG. 27. The waterline is indicated by reference numeral 87. The bow rails 89 are installed at the stems of each of the port, center and starboard hulls 91, 93 and 95, and run toward the waterline 87 at an acute angle of 5° to 20°. The bow rails 89 have densities ranging from 2.2 to 6.6 PCF and functional attributes A, B, D, E, F and H. Only two fender rails 97 are horizontally installed amidships, 8" to 24" above the waterline 87: the one fender rail 97 being installed on the port side of the port hull 91 and the second fender rail 97 being installed on the starboard side of the starboard hull 95. The fender rails 97 have densities ranging from 2.2 to 9.5 PCF and functional attributes E, F and H. One stern rail 99 is horizontally installed across the full width of the transom of the port hull 91, 6" to 10" above the waterline 87; a second stern rail 101 is horizontally installed across the full width of the transom of the center hull 93, 6" to 10" above the waterline 87; and the third stern rail 103 is horizontally installed across the full width of the transom of the starboard hull 95, 6" to 10" above the waterline 87. The stern rails 99, 101 and 103 have densities ranging from 2.2 to 6.6 PCF and functional attributes A, E, F and H.

Figure 29:
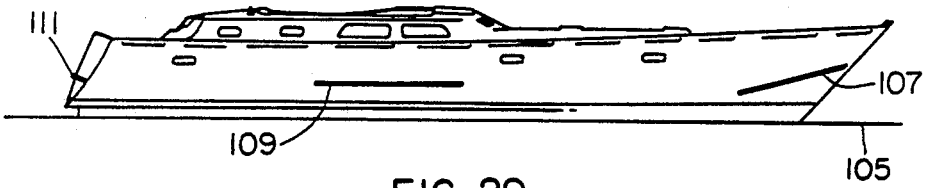
FIG. 29 is a starboard-side elevational view of a sailboat having a reverse transom.

FIG. 29 depicts a starboard-side elevational view of a sailboat having a transom whose bottom edge is above the waterline, indicated by reference numeral 105. The sailboat is depicted with its mast removed. A port-side elevational view would be the same as FIG. 29. For hull lengths ranging from 28' to 40', the bow rails 107 are installed approximately 24" to 36" above the waterline 105, 2" back from the stem and running toward the waterline 105 at an acute angle of 10° to 30°; and, for a hull length less than 28', the bow rails 107 are installed approximately 12" to 24" above the waterline 105, 2: back from the stem and running toward the waterline at an acute angle of 10° to 30°. The bow rails 107 have densities ranging from 2.2 to 6.6 PCF and functional attributes A, B, D, E, F and H. The fender rails 109 are horizontally installed on both the starboard and port sides, 8" to 24" above the waterline 105, running from amidships toward the stern, but spatially occupying less than one-half the distance from amidships to stern. The fender rails 109 have densities ranging from 2.2 to 9.5 PCF and functional attributes E, F and H. The stern rail 111 is horizontally installed the full width of the reverse transom at a distance of ¼ to ½ the distance up the reverse transom. The stern rail has densities ranging from 2.2 to 6.6 PCF and functional attributes A, E, F and H.

Figure 30:
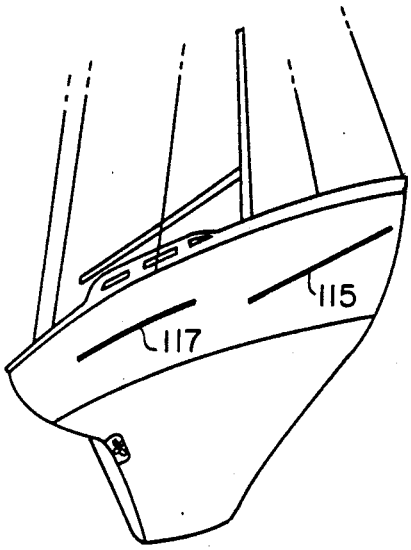
FIGS. 30–33 are perspective, front-elevational, rear-elevational and starboard-side elevational views, respectively, of a displacement-type fixed-keel sailboat.
Figure 31:
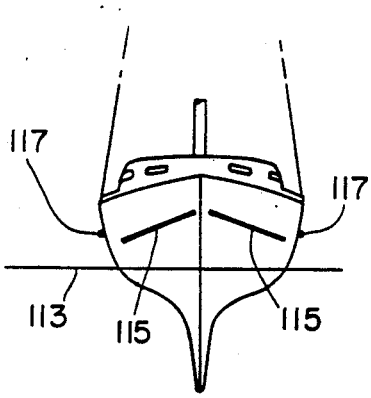
Figure 32:
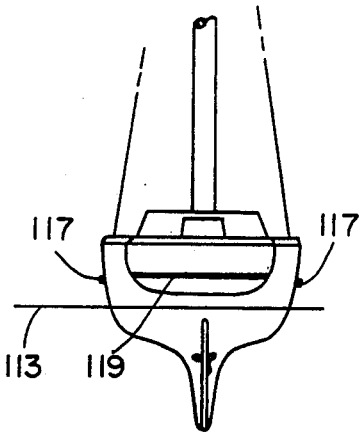
Figure 33:
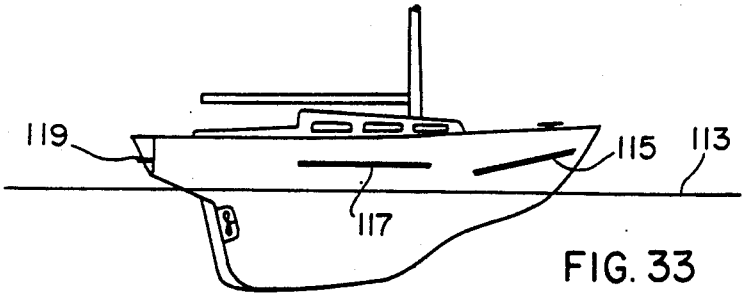

In FIGS. 30–33, which depict a round-bottom, fixed-keel sailboat, FIG. 30 is a perspective view, FIG. 31 is a front-elevational view, FIG. 32 is a rear-elevational view and FIG. 33 is a starboard-side elevational view. A port-side elevational view would be the same as FIG. 33. The waterline is indicated by reference numeral 113. For hull lengths ranging from 28' to 40', the bow rails 115 are installed approximately 24" to 36" above the waterline 113, 2" back from the stem and running toward the waterline 113 at an acute angle of 10° to 30°. For a bow length of less than 28', the bow rails 115 are installed 12" to 24" above the waterline 113, 2" back from the stem and running toward the waterline 113 at an acute angle of 10° to 30°. The bow rails 115 have densities ranging from 2.2 to 6.6 PCF and functional attributes A, B, D, E, F and H. As shown, the fender rails 117 are horizontally installed amidships on both the starboard and port sides, 8" to 24" above the waterline 113. The fender rails 117 have densities ranging from 2.2 to 9.5 PCF and functional attributes E, F and H. As shown, the stern rail 119 is horizontally installed the full width of the raised transom at a level of ¼ to ½ the distance up the face of the raised transom. The density of the stern rail ranges from 2.2 to 6.6 PCF and has functional attributes A, E, F and H.

FUNCTIONAL ATTRIBUTE A

The rails that have functional attribute A deflect spray. For example, the bow of a boat, plowing through water, causes water spray to be churned up and which churned-up spray flows over and upon the starboard and port sides and into the boat. All rails that have functional attribute A, especially the bow rails, function as physical barriers to intercept such water spray and deflect such water spray away from the boat.

FUNCTIONAL ATTRIBUTE B

When the bow of a boat plows through choppy or turbulent seas, the water impacts the bow with such force that the bow goes under. The bow rails have functional attribute B in that such choppy or turbulent water, upon impacting the bow-installed rails, continuously acts as a lifting force component against the bow rails to raise the bow of the boat and thereby reduces the prior tendency of the bow to go under.

FUNCTIONAL ATTRIBUTE C

When a boat makes a starboard turn, for example, the resulting and reactive centrifugal force, depending upon the speed of the boat, will cause the port side of the boat to rise above the water or heel and to skip or side-slip to its port side. The starboard-side rail, having functional attribute C, grabs or bites the water to act like a brake upon or within the water, with the result that heel and side-slipping are reduced.

FUNCTIONAL ATTRIBUTE D

When the bow of the boat is speeding through water, the plowed water will rise to impact the bow rails that have functional attribute D, with such water impacting against the bow rails and providing continuous impacting force components against the bow rails to contribute lift to the hull. Likewise, other rails, having functional attribute D, are continuously impacted against by the water, thereby providing force components which effect a degree of lift to the hull.

FUNCTIONAL ATTRIBUTE E

All rails, having functional attribute E, act as fenders to protect the hull from damage when such rails come into contact with a dock, pier, pilings, other boats and floating objects. With reference to FIGS. 15–18, it could be said that the hull would be protected against damage if rail 57, possessing functional attribute G, is struck by a submerged log, aligned with rail 57.

FUNCTIONAL ATTRIBUTE F

The rails that have functional attribute F contribute a safety factor by providing an accessible hand hold or foot step for a man or woman overboard, or a swimmer, whether or not in distress, by which access to the boat can be gained, or simply to hold onto such rail until help arrives for purposes of rescue.

FUNCTIONAL ATTRIBUTE G

Boats, moored or anchored, are subjected to rocking movements, principally from the wakes caused by other boats. Boats are further subjected to rocking movements from the natural effects of wind and waves. The rails of boats that have functional attribute G resist rocking by grabbing or biting into the water.

FUNCTIONAL ATTRIBUTE H

Rails in or upon the water provide floatation or buoyancy for the boat. Other rails that come into contact with the water when the boat begins to sink provide floatation or buoyancy to the boat. Thus, it can be said that all rails have functional attribute H, presently or prospectively.

Figure 34:
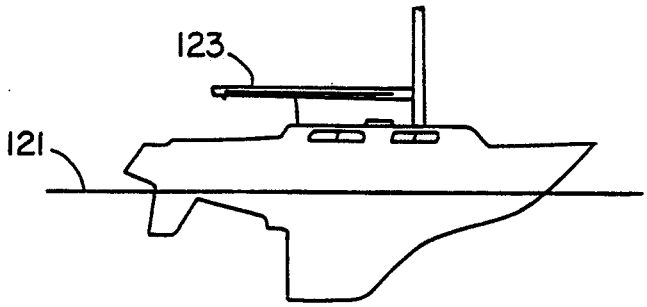
FIG. 34 is a starboard-side elevational view of a fixed-keel sailboat.
Figure 35:
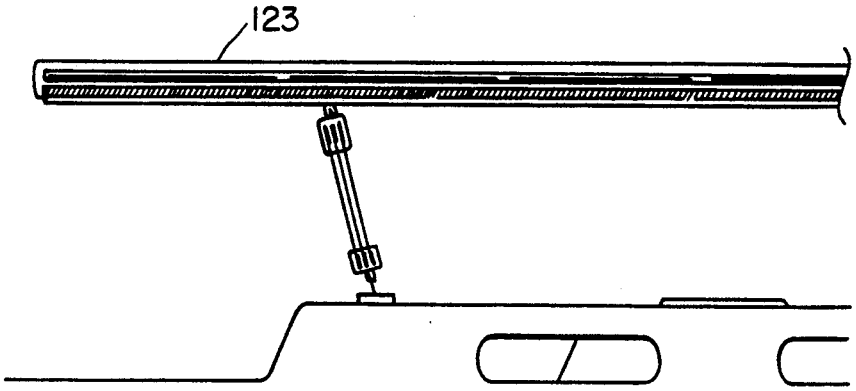
FIG. 35 is a partial blown-up view of the sailboat shown in FIG. 34.
Figure 36:
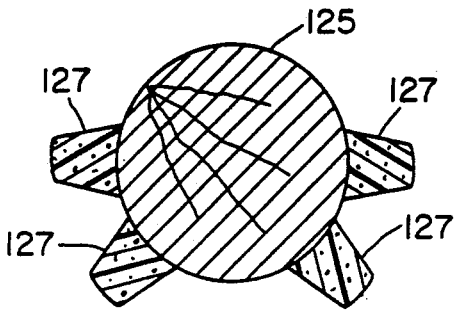
FIG. 36 is a cross-sectional view of a round-configured boom of a sailboat.
Figure 37:
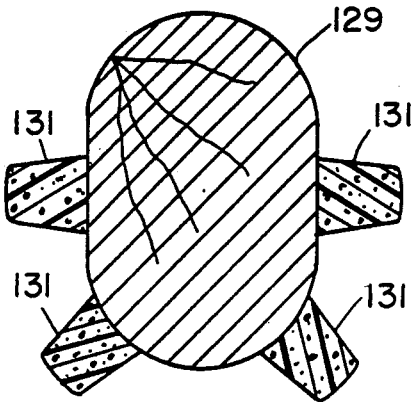
FIG. 37 is a cross-sectional view of an oval-configured boom of a sailboat.

In FIGS. 34 and 35, FIG. 34 is a starboard-side elevational view of a fixed-keel sailboat and FIG. 35 is a partial, blownup view of the sailboat shown in FIG. 34. The waterline is indicated by reference numeral 121. The purposes of FIGS. 34 and 35 are to show the boom 123 in its environment for purposes of further description. On all types of sailboats, a swinging boom is a well-known cause of serious bodily injury, principally to the head of a person. A change in direction of the wind or a change in direction of the boat, while under sail, can cause violent movements of the boom, snapping like a whip from starboard to port and from port to starboard: when changing tack; while heading directly into the wind, with the sails and boom shaking violently; and, when running before the wind with the wind from astern, it is often difficult to maintain a straight course with the result that a "jibe" occurs, which causes the boom to snap violently from side to side. This problem occurs with all sailboats, without regard to whether the sailboat has a fixed keel or centerboard. FIG. 36 is a cross-sectional view of a round boom 125 having installed safety rails 127 at the approximate 3 o'clock, 4:30, 7:30 and 9 o'clock positions, with the round boom 125 representing the round face of a clock. FIG. 37 is a cross-sectional view of an oval boom 129 having installed safety rails 131 at the approximate 3 o'clock, 4:30, 7:30 and 9 o'clock positions, with the oval boom 129 representing the face of an oval clock. The safety rails 127 and 131 are of the same type shown and described with reference to FIG. 1, with the polyetylene foam, coated with the exterior skin of woven fabric. The material utilized for the safety rails 127 and 131 is the low density #200LC or #220 polyethylene foam having respective densities of 1.9 PCF and 2.2 PCF to thereby prevent a person from sustaining any injury when he or she is struck in the head, unsuspectingly, when the boom whips across.

I claim:

1. A system of elongated rail means for the hulls of any one of displacement planing or deep-v boats, cathedral planing boats and flatbottomed runabout boats, said boat hulls having exterior hull surfaces, said exterior hull surfaces and said rail means being in structural bonding relationships, said rail means, in such structural bonding relationships, projecting externally from said exterior hull surfaces, said rail means providing physical barriers to intercept and deflect water spray away from the boats; providing physical barriers against which choppy or turbulent seas impact to raise the bows of the boats to reduce the tendencies of the bows of the boats to go under in plowing through such choppy or turbulent seas; grabbing or biting the water to act as brakes upon or within the water to reduce heel and side-slipping of the boats from the effects from resulting and reacting centrifugal forces when the boats turn; providing physical barriers against which waters continuously impact to contribute lift to the hulls of boats when the boats are speeding or plowing through such waters; acting as fenders to protect the hulls of the boats when docks, piers, pilings, other boats, floating objects and submerged objects come into contact with said rail means; contributing safety factors by providing accessible hand holds and foot steps for men and women overboard, or swimmers, whether or not in distress, by which access to the boats can be gained, or to hold onto said rail means until help arrives for purposes of rescue; providing physical barriers to resist rocking movements imparted to the boats from wakes caused by other boats or from the natural effects from winds or waves; providing floatation and buoyancy for the boats; and said rail means having elongated rails in such structural bonding relationships with said exterior hull surfaces, said rails cross-sectionally defining truncated isosceles triangles having bottom bases, top bases and lateral sides, said lateral sides having uppermost portions, said top bases of said rails, joining said uppermost portions of said lateral sides, having radius-curve corners, said exterior hull surfaces and said bottom bases of said rails being in common engagements, and each of said rails having an exterior skin of woven fabric material coating and enclosing an interior of polyethylene foam.

2. A system in accordance with claim 1, wherein said woven fabric material has depending end flaps adhesively and structurally bonding said rail to said exterior hull surface.

3. A system in accordance with claim 2, wherein said polyethylene foam has a density ranging from 2.2 to 9.5 pounds per cubic foot.

4. A system in accordance with claim 1, wherein said polyethylene foam has a density ranging from 2.2 to 9.5 pounds per cubic foot.

5. A system of elongated rail means for the hulls of any one of displacement sailboats, double-hulled sailboats, double-hulled power boats and multihulled trimaran sailboats, said boat hulls having exterior surfaces, said exterior hull surfaces and said rail means being in structural bonding relationships, said rail means, in such structural bonding relationships, projecting externally from said exterior hull surfaces, said rail means providing physical barriers to intercept and deflect water spray away from the boats; providing physical barriers against which choppy or turbulent seas impact to raise the bows of the boats to reduce the tendencies of the bows of the boats to go under in plowing through such choppy or turbulent seas; providing physical barriers against which waters continuously impact to contribute lift to the hulls of the boats when the boats are speeding or plowing through such waters; acting as fenders to protect the hulls of the boats when docks, piers, pilings, other boats, floating objects and submerged objects come into contact with said rail means; contributing safety factors by providing accessible hand holds and foot steps for men and women overboard, or swimmers, whether or not in distress, by which access to the boats can be gained, or to hold onto said rail means until help arrives for purposes of rescue; providing floatation and buoyancy for the boats; and said rail means having elongated rails in such structural bonding relationships with said exterior hull surfaces, said rails cross-sectionally defining truncated isosceles triangles having bottom bases, top bases and lateral sides, said lateral sides having uppermost portions, said top bases of said rails, joining said uppermost portions of said lateral sides, having radius-curve corners, said exterior hull surfaces and said bottom bases of said rails being in common engagements, and each of said rails having an exterior skin of woven fabric material coating and enclosing an interior of polyethylene foam.

6. A system in accordance with claim 5, wherein said woven fabric material has depending end flaps adhesively and structurally bonding said rail to an exterior hull surface.

7. A system in accordance with claim 6, wherein said polyethylene foam has a density ranging from 2.2 to 9.5 pounds per cubic foot.

8. A system in accordance with claim 5, wherein said polyethylene foam has a density ranging from 2.2 to 9.5 pounds per cubic foot.

9. A system of elongated rail means for the hulls of round-bottomed cruiser boats, said boat hulls having exterior hull surfaces, said exterior hull surfaces and said rail means being in structural bonding relationships, said rail means, in such structural bonding relationships, projecting externally from said exterior hull surfaces, said rail means providing physical barriers to intercept and deflect water spray away from the boats; providing physical barriers against which choppy or turbulent seas impact to raise the bows of the boats to reduce the tendencies of the bows of the boats to go under in plowing through such choppy or turbulent seas; providing physical barriers against which waters continuously impact to contribute lift to the hulls of the boats when the boats are speeding or plowing through such waters; acting as fenders to protect the hulls of the boats when docks, piers, pilings, other boats and floating objects come into contact with said rail means; contributing safety factors by providing accessible hand holds and foot steps for men and women overboard, or swimmers, whether or not in distress, by which access to the boats can be gained, or to hold onto said rail means until help arrives for purposes of rescue; providing physical barriers to resist rocking movements imparted to the boats from wakes caused by other boats or from the natural effects from winds and waves; providing floatation and buoyancy for the boats; and said rail means having elongated rails in such structural bonding relationships with said exterior hull surfaces, said rails crosssectionally defining truncated isosceles triangles having bottom bases, top bases and lateral sides, said lateral sides having uppermost portions, said top bases of said rails, joining said uppermost portions of said lateral sides, having radius-curve corners, said exterior hull surfaces and said bottom bases of said rails being in common engagements, and each of said rails having an exterior skin of woven fabric material coating and enclosing an interior of polyethylene foam.

10. A system in accordance with claim 9, wherein said woven fabric material has depending end flaps adhesively and structurally bonding said rail to an exterior hull surface.

11. A system in accordance with claim 10, wherein said polyethylene foam has a density ranging from 2.2 to 9.5 pounds per cubic foot.

12. A system in accordance with claim 9, wherein said polyethylene foam has a density ranging from 2.2 to 9.5 pounds per cubic foot.

13. An elongated rail for installation on an exterior hull surface of a boat, said rail defining cross-sectionally a truncated isosceles triangle having a bottom base, a top base and lateral sides, said lateral sides having uppermost portions, said top base, joining said uppermost portions of said lateral sides, having radius-curve corners, said rail having an exterior skin of woven fabric material coating and enclosing an interior of polyethylene foam, said woven fabric material having end flaps, depending below said bottom base, for adhesively and structurally bonding said rail to a portion of the exterior hull surface.

14. An elongated rail in accordance with claim 13, wherein said polyethylene foam ranges in density from 1.9 to 9.5 pounds per cubic foot.

15. In a sailboat having a boom, said boom having laterally projecting elongated safety rails to prevent injury to a person struck in the course of violent movements of the boom, said safety rails being of low-density polyethylene foam.

16. A boom in asccordance with claim 15, wherein said boom cross-sectionally is of round configuration and wherein said safety rails are at approximate 3:00 o'clock, 4:30, 7:30 and 9:00 o'clock positions with respect to the boom.

17. A boom in accordance with claim 16, wherein the low-density foam ranges from 1.9 to 2.2 pounds per cubic foot.

18. A boom in accordance with claim 15, wherein said boom cross-sectionally is of oval configuration and wherein said safety rails are at approximate 3:00 o'clock, 4:30, 7:30 and 9:00 o'clock positions with respect to said boom.

19. A boom in accordance with claim 18, wherein the low-density foam ranges from 1.9 to 2.2 pounds per cubic foot.

* * * * *